US006856334B1

(12) United States Patent
Fukui

(10) Patent No.: US 6,856,334 B1
(45) Date of Patent: Feb. 15, 2005

(54) SHEET MATERIAL FIXING DEVICE

(75) Inventor: Takashi Fukui, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/385,742

(22) Filed: Mar. 12, 2003

(30) Foreign Application Priority Data

Mar. 27, 2002 (JP) ..... 2002-088858

(51) Int. Cl.[7] ..... B41F 27/06
(52) U.S. Cl. ..... 346/138; 271/277; 101/409
(58) Field of Search ..... 347/262, 264, 347/218, 104; 346/134, 138; 271/277; 101/408–410, 477

(56) References Cited

U.S. PATENT DOCUMENTS 4,111,123 A 9/1978 Willeitner
5,324,023 A 6/1994 Fedorjaka
6,189,452 B1 2/2001 Halup et al.
6,459,475 B1 10/2002 Fukui
6,572,104 B2 * 6/2003 Fukui ..... 271/277

FOREIGN PATENT DOCUMENTS

JP A-2001-194767 7/2001

* cited by examiner

*Primary Examiner*—Huan Tran
(74) *Attorney, Agent, or Firm*—Taiyo, Nakajima & Kato

(57) ABSTRACT

A device for fixing a sheet material to a cylindrical rotating member. Without using a suction mechanism and a vacuum, pressing portions of sheet material leading end clamps provided at a peripheral surface of the rotating member press the sheet material against the peripheral surface of the rotating member and fix the sheet material thereat. Each pressing portion has a region which deforms most due to centrifugal force generated by the rotating member. The pressing portion is formed in advance on the whole in a bow-like shape such that this region projects the most toward a center of the rotating member. Due to deformation caused by centrifugal force, the pressing portion changes from bow-shaped to planar, and uniformly presses the sheet material without a gap therebetween.

16 Claims, 8 Drawing Sheets

SHEET MATERIAL FIXING DEVICE

BACKGROUND OF THE INVENTION

1. Field of the Invention

The present invention relates to a sheet material fixing device which fixes a sheet material onto the peripheral surface of a rotating member.

2. Description of the Related Art

Printing plate exposure devices have been developed which record (expose) an image directly by a laser beam or the like onto an image forming layer (e.g., a photosensitive layer or a heat-sensitive layer) of a sheet-shaped printing plate (e.g., photopoly plate or a thermal plate).

The printing plate exposure device is equipped with, for example, a rotating drum. The rotating drum is hollow cylindrical, and both ends thereof are closed. A printing plate is conveyed on the peripheral surface of the rotating drum. A pressure-reducing blower communicates with the interior of the rotating drum. A large number of suction holes and suction grooves are formed in the peripheral surface of the rotating drum. When a printing plate is being conveyed on the peripheral surface of the rotating drum, the pressure at the interior of the rotating drum is reduced by the pressure-reducing blower. The printing plate is thereby vacuum-adsorbed via the many suction holes and suction grooves, and is fixed to the peripheral surface of the rotating drum.

A recording head portion is provided in a vicinity of the rotating drum. While the rotating drum is rotated at high speed, a light beam from the recording head portion is irradiated onto the printing plate which is fixed on the peripheral surface of the rotating drum. The printing plate is thereby subjected to exposure processing.

However, in this printing plate exposure device, the machining for forming the large number of suction holes and suction grooves in the peripheral surface of the rotating drum is costly, and in addition, the pressure-reducing blower is required. Accordingly, problems arise in that the manufacturing costs increase, and that, due to the pressure-reducing blower, the surface area required for placement increases and noise is generated.

Yet another problem arises in addition to the aforementioned problems. In printing plate exposure devices which are currently being developed, the printing plate is fixed to the peripheral surface of the rotating drum by the leading end and the trailing end of the printing plate, which is being conveyed on the peripheral surface of the rotating drum, being pressed against the peripheral surface by leading end clamps and trailing end clamps, respectively.

However, in such a printing plate exposure device, the printing plate is not adsorbed to the peripheral surface of the rotating drum. Accordingly, at the time when the rotating drum is rotated at high speed, if the printing plate pressing portions of the leading end clamps and the trailing end clamps deform due to centrifugal force, it is difficult to uniformly press the leading end and the trailing end of the printing plate against the peripheral surface of the rotating drum. Thus, it is difficult to make the entire printing plate fit tightly to the peripheral surface of the rotating drum.

SUMMARY OF THE INVENTION

In view of the aforementioned, an object of the present invention is to provide a sheet material fixing device which, with a structure that is low-cost, requires little surface area for placement, and does not generate noise, can uniformly press a sheet material against the peripheral surface of a rotating member at the time the rotating member is rotated.

The sheet material fixing device has a rotating member, a holding member, and a pressing portion. The rotating member is rotatable, and a sheet material is disposed on the peripheral surface thereof. The holding member is provided at the peripheral surface of the rotating member. The pressing portion is provided at the holding member, and is formed so as to project progressively more toward the rotating member the further toward positions of the pressing portion where the amount of deformation thereof toward the side opposite the rotating member, due to the centrifugal force at the time when the rotating member rotates, increases. The pressing portion also presses the sheet material against the peripheral surface of the rotating member.

In the sheet material fixing device, the pressing portion of the holding member provided at the peripheral surface of the rotating member presses the sheet material against the peripheral surface of the rotating member. The sheet material is thereby fixed to the peripheral surface of the rotating member. Thus, not only are the conventional many suction holes and suction grooves not needed, but also, a pressure-reducing blower is unnecessary. Thus, it is possible to realize a structure which is low-cost, requires little space for placement, and does not generate noise.

Moreover, the pressing portion projects more and more toward the rotating member, the further toward positions of the pressing portion where the amount of deformation thereof toward the side opposite the rotating member, due to the centrifugal force at the time when the rotating member rotates, increases. Thus, even if the pressing portion deforms toward the side opposite the rotating member due to centrifugal force at the time when the rotating member is rotated, the pressing portion can press the sheet material without a gap therebetween. The pressing portion can thereby uniformly press the sheet material against the peripheral surface of the rotating member.

The sheet material fixing device of the present invention may have a plurality of the holding members and pressing portions. There are cases in which some of the pressing portions press one end of the sheet material against the peripheral surface of the rotating member, and the other pressing portions press the other end of the sheet material against the peripheral surface of the rotating member.

In the sheet material fixing device in this case, some of the pressing portions press one end of the sheet material against the peripheral surface of the rotating member, whereas the other pressing portions press the other end of the sheet material against the peripheral surface of the rotating member. Moreover, as described above, each pressing portion can press the sheet material uniformly against the peripheral surface of the rotating member. Thus, when the rotating member is rotated, floating-up of the sheet material from off of the peripheral surface of the rotating member due to centrifugal force and against the pressing force of the pressing portion can be suppressed. The entire sheet material can be made to fit tightly to the peripheral surface of the rotating member.

DESCRIPTION OF THE PREFERRED EMBODIMENTS

Figure 7:
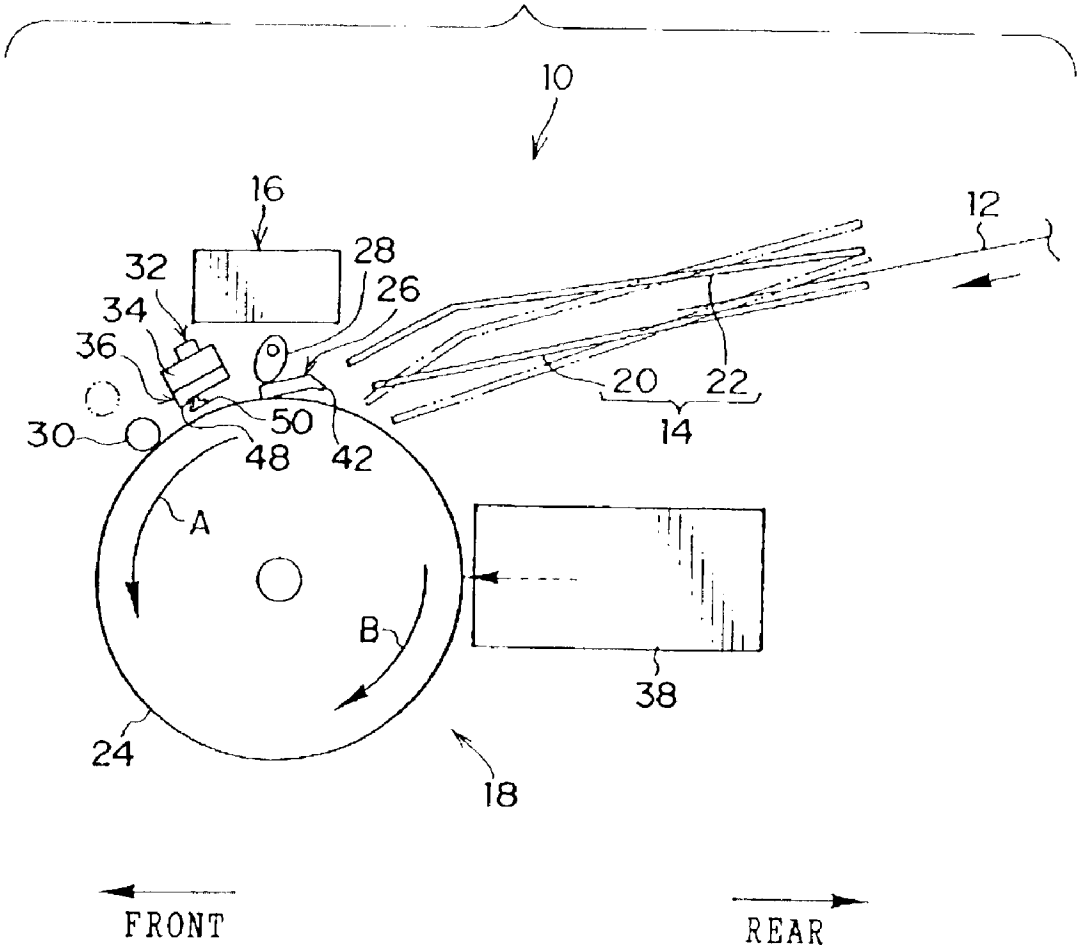
FIG. 7 is a schematic side view showing the automatic printing plate exposure device relating to the embodiment of the present invention.

An automatic printing plate exposure device 10, which relates to the embodiment and to which the sheet material fixing device of the present invention is applied, is shown in side view in FIG. 7.

The automatic printing plate exposure device 10 relating to the present embodiment exposes (records) an image onto an image forming layer (e.g., photosensitive layer or heat-sensitive layer) on a support of a printing plate 12 which is a photopoly plate or a thermal plate or the like and which serves as a sheet material. The automatic printing plate exposure device 10 is divided into a conveying guide unit 14, a punching section 16, and an exposure section 18. The punching section 16 and the exposure section 18 are disposed in front of the conveying guide unit 14, and the exposure section 18 is disposed beneath the punching section 16.

The conveying guide unit 14 has a plate supplying guide 20, which is formed as a substantially rectangular flat plate, and a plate discharging guide 22, which is formed as a substantially rectangular flat plate. The plate supplying guide 20 and the plate discharging guide 22 are disposed relative to one another so as to form a sideways V shape. The conveying guide unit 14 is structured so as to be able to pivot over a predetermined angle, with a vicinity of the center in FIG. 7 being the center of pivoting. Due to the conveying guide unit 14 pivoting, the plate supplying guide 20 and the plate discharging guide 22 can be selectively made to correspond to the punching section 16 or the exposure section 18. The printing plate 12 is supplied onto the plate supplying guide 20.

Here, due to the conveying guide unit 14 pivoting such that the plate supplying guide 20 corresponds to (faces) the punching section 16, the leading end portion of the printing plate 12 on the plate supplying guide 20 is conveyed into the punching section 16. A predetermined number of punch holes (not shown), e.g. round holes, long holes, or the like, are punched in the leading end portion of the printing plate 12 by the punching section 16. When processing at the punching section 16 has been completed, the printing plate 12 is returned onto the plate supplying guide 20.

Figure 5:
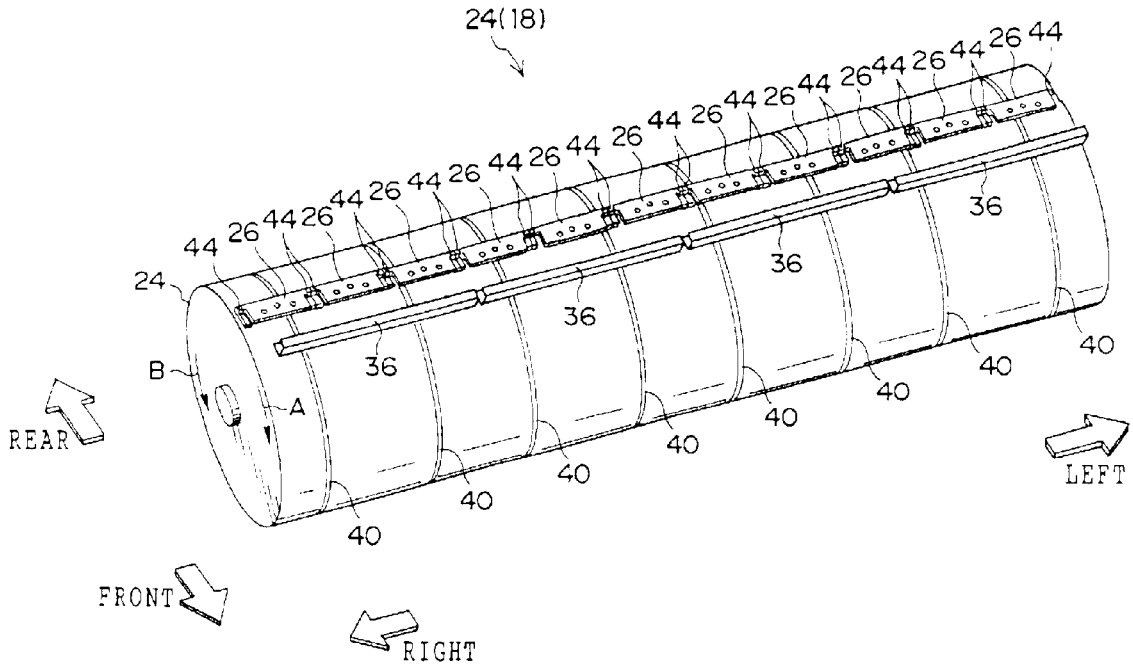
FIG. 5 is a perspective view showing a rotating drum, the leading end clamps and the trailing end clamps of the automatic printing plate exposure device relating to the embodiment of the present invention.

The exposure section 18 has a rotating drum 24 serving as a rotating member. The rotating drum 24 is solid-cylindrical, and can rotate in the direction of arrow A and in the direction of arrow B in FIG. 7. A predetermined number of fixing holes 40 are formed in the peripheral surface of the rotating drum 24. In the present embodiment, eight fixing holes 40 are formed. The fixing hole 40 is formed along the entire peripheral direction of the peripheral surface of the rotating drum 24. The region of the fixing hole 40 nearer to the outer side of the rotating drum 24 is formed to be narrower in the left-right direction than the region of the fixing hole 40 nearer to the inner side of the rotating drum 24 (refer to FIGS. 5, 6A, and 6B). This left-right direction is substantially orthogonal to the direction of conveying of the printing plate. Here, when the printing plate 12 is returned onto the plate supplying guide 20 from the punching section 16 as described above, the conveying guide unit 14 is pivoted such that the plate supplying guide 20 corresponds to the exposure section 18 (opposes the rotating drum 24 in a direction tangential to the rotating drum 24). In this way, the leading end of the printing plate 12 is conveyed onto (placed on) the peripheral surface of the rotating drum 24, and the printing plate 12 is positioned.

A predetermined number of leading end clamps 26 serving as holding members are provided along the left-right direction (see FIG. 5) on the peripheral surface of the rotating drum 24 at the position to which the leading end of the printing plate 12 is conveyed. In the present embodiment, 11 leading end clamps 26 are provided. The leading end clamp 26 is formed of plastic (in the present embodiment, an engineering plastic such as nylon 66 resin), and is formed in a plate shape which is V-shaped in cross-section. Elastic force in a direction of moving away from the peripheral surface of the rotating drum 24 is applied to the front side of the leading end clamp 26. A leading end pressing portion 42 serving as a pressing portion is formed at the rear end of the leading end clamp 26.

Figure 1:
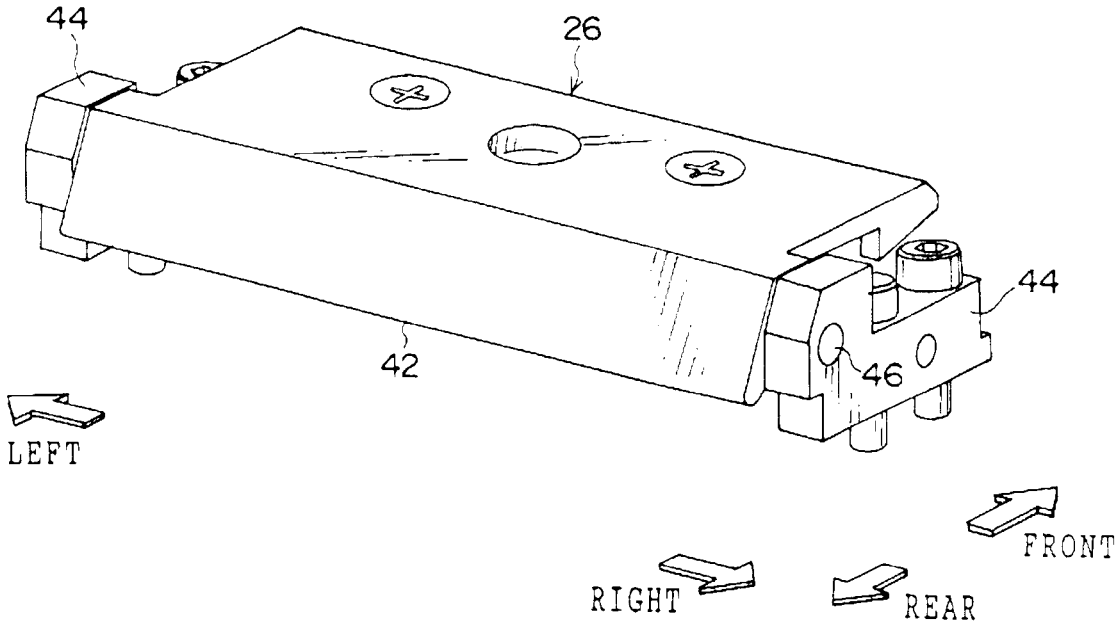
FIG. 1 is a perspective view showing a leading end clamp of an automatic printing plate exposure device relating to an embodiment of the present invention.

As shown in FIG. 1, a supporting member 44 is provided at each of the left-right direction sides of the leading end clamp 26. Each supporting member 44 is fixed to the peripheral surface of the rotating drum 24. A supporting shaft 46 is provided integrally with each left-right direction end of the leading end clamp 26. Due to the respective supporting shafts 26 being supported by the respective supporting members 44, the leading end clamp 26 is supported at the rotating drum 24 so as to be freely rotatable via the supporting members 44. Thus, when the rotating drum 24 is rotated at high speed as will be described later, due to the centrifugal force, the leading end clamps 26 (including the leading end pressing portions 42) deform in a direction of moving away from the rotating drum 24. The deformation becomes greater the further toward the left-right direction center of the leading end clamp 26.

Figure 2:
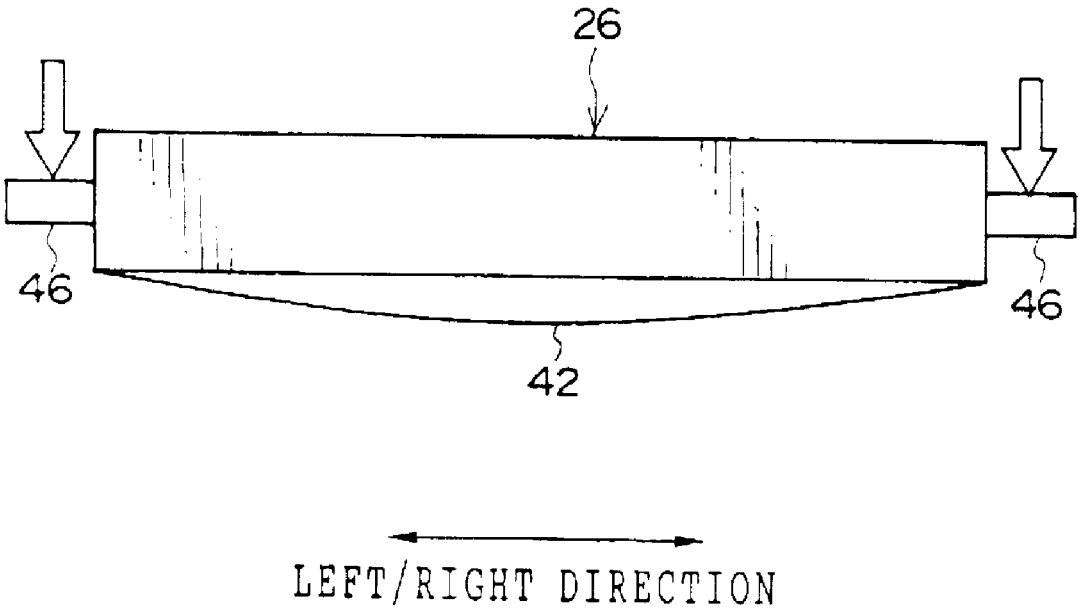
FIG. 2 is a front view showing the leading end clamp of the automatic printing plate exposure device relating to the embodiment of the present invention.

As shown in FIG. 2, the bottom end of the leading end pressing portion 42 (the end at the rotating drum 24 side) is formed in a bow shape (crown shape) in which the left-right direction center protrudes further downwardly (toward the rotating drum 24) than both left-right direction ends. The bottom end of the leading end pressing portion 42 protrudes toward the rotating drum 24 progressively more, the further toward positions of the leading end pressing portion 42 where the amount of deformation thereof toward the side opposite the rotating drum 24, due to the centrifugal force at the time when the rotating drum 24 is rotated at high speed, increases. In this way, when the rotating drum 24 is rotated at high speed, the lower end of the leading end pressing portion 42 becomes planar due to the deformation of the leading end pressing portion 42.

As shown in FIG. 1, the supporting shafts 46 are disposed at the rear side of the leading end clamp 26. The mass of the leading end clamp 26 at the region thereof further toward the front than the supporting shafts 46 is greater than the mass of the leading end clamp 26 at the region thereof further toward the rear than the supporting shafts 46. Thus, when the rotating drum 24 is rotated at high speed, the centrifugal force received at the region of the leading end clamp 26 at the front side of the supporting shafts 46 is greater than the centrifugal force received at the region of the leading end clamp 26 at the rear side of the supporting shafts 46. In this way, torque, in a direction of directing the leading end pressing portion 42 toward the peripheral surface of the rotating drum 24, is applied to the leading end clamp 26.

As shown in FIG. 7, an attaching cam 28 is provided above each leading end clamp 26. Due to the respective attaching cams 28 pressing the front sides of the leading end clamps 26, the leading end pressing portions 42 at the rear ends of the leading end clamps 26 move away from the peripheral surface of the rotating drum 24 against the aforementioned elastic force. In this way, the leading end of the printing plate 12, which has been conveyed onto the peripheral surface of the rotating drum 24 from the plate supplying guide 20 as described above, is inserted between the peripheral surface of the rotating drum 24 and the leading end pressing portions 42 at the rear ends of the leading end clamps 26. In this state, positioning of the printing plate 12 is carried out. After positioning of the printing plate 12 has been completed, the respective attaching cams 28 are rotated such that their pressing of the front sides of the leading end clamps 26 is released. In this way, due to the aforementioned elastic force, the leading end pressing portions 42 at the rear ends of the predetermined number of leading end clamps 26 press substantially the entire leading end of the printing plate 12 against the peripheral surface of the rotating drum 24, and the leading end of the printing plate 12 is fixed to the peripheral surface of the rotating drum 24. Then, when the leading end of the printing plate 12 is fixed to the peripheral surface of the rotating drum 24, the rotating drum 24 is rotated in the direction of arrow A in FIG. 7 such that the printing plate 12 is trained around the peripheral surface of the rotating drum 24.

A solid cylindrical squeeze roller 30 is disposed at the arrow A direction side in FIG. 7 of the attaching cams 28, in a vicinity of the peripheral surface of the rotating drum 24. The squeeze roller 30 is moved toward the rotating drum 24. In this way, while the printing plate 12 trained around the rotating drum 24 is pressed toward the rotating drum 24, the rotating drum 24 is rotated and the printing plate 12 is made to fit tightly to the peripheral surface of the rotating drum 24.

A trailing end clamp attaching/removing unit 32 is disposed between the attaching cams 28 and the squeeze roller 30 in a vicinity of the peripheral surface of the rotating drum 24. The trailing end clamp attaching/removing unit 32 has a rising/falling frame 34. The rising/falling frame 34 can move toward the rotating drum 24. A predetermined number (four in the present embodiment) of trailing end clamps 36 serving as holding members are attached to the rising/falling frame 34 along the left-right direction (See FIG. 5). The trailing end clamp 36 is rectangular plate shaped. The upper end of a coil spring (not shown) is fixed to the bottom surface of the rear side of the trailing end clamp 36.

Figure 3:
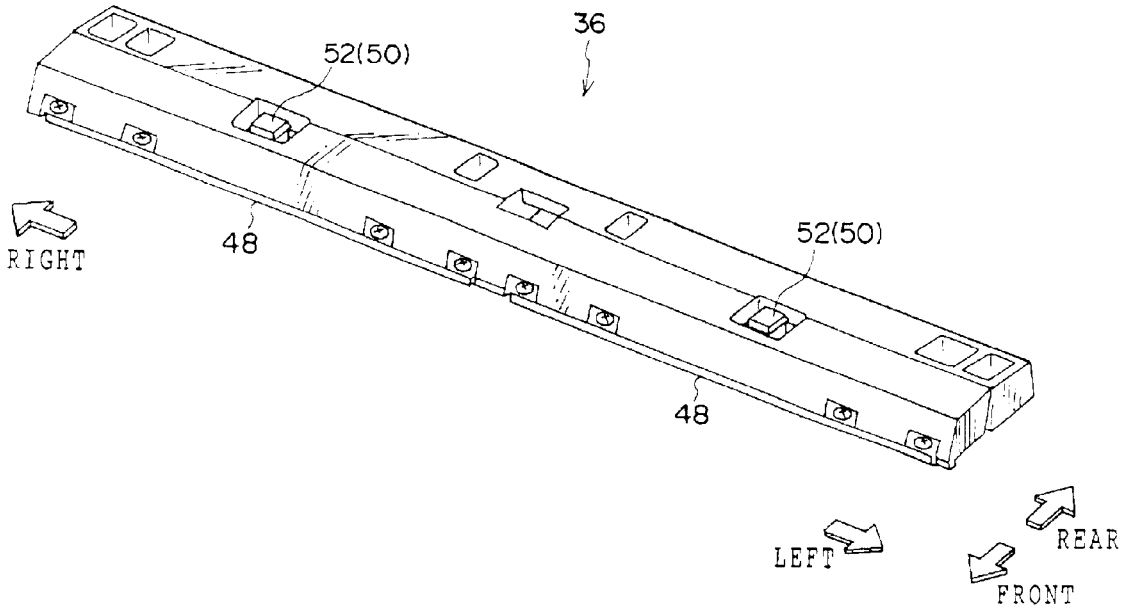
FIG. 3 is a perspective view showing a trailing end clamp of the automatic printing plate exposure device relating to the embodiment of the present invention.

As shown in FIG. 3, a trailing end pressing plate 48 serving as a pressing portion is provided at each of the right side region lower end and the left side region lower end of the front end of the trailing end clamp 36. The surface of the trailing end pressing plate 48 is formed of a rubber-coated metal (aluminum in the present embodiment), and the coefficient of friction of the trailing end pressing plate 48 is high.

An attaching/removing lever 50 is rotatably provided at each of a substantial center of the right side region and a substantial center of the left side region of the trailing end clamp 36. The trailing end clamp 36 is swingable around the pair of attaching/removing levers 50. Nuts 52 are fixed to the upper ends of the attaching/removing levers 50, and are exposed from the top surface of the trailing end clamp 36. Further, the lower sides of the attaching/removing levers 50 project from the bottom surface of the trailing end clamp 36. The bottom ends of the attaching/removing levers 50 are formed such that their front-rear direction dimension is long and their left-right direction dimension is short (see FIG. 6A and FIG. 7).

Figure 6A:
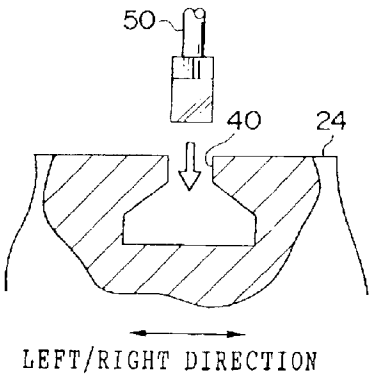
FIG. 6A is a cross-sectional view showing a method of attaching the trailing end clamp to the rotating drum of the automatic printing plate exposure device relating to the embodiment of the present invention, and shows a state in which an attaching/removing lever of the trailing end clamp is being inserted into a fixing hole of the rotating drum.
Figure 6B:
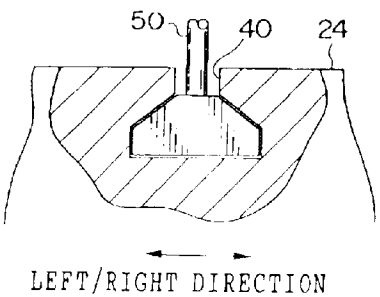
FIG. 6B is a cross-sectional view showing the method of attaching the trailing end clamp to the rotating drum of the automatic printing plate exposure device relating to the embodiment of the present invention, and shows a state in which removal of the attaching/removing lever from the fixing hole is not possible.

Here, when the trailing end of the printing plate 12 trained on the rotating drum 24 opposes the trailing end clamp attaching/removing unit 32, the rising/falling frame 34 is lowered, and the trailing end clamps 36 are moved toward the rotating drum 24. In this way, as shown in FIG. 6A, the attaching/removing levers 50 are inserted into the fixing holes 40 of the rotating drum 24. Thereafter, as shown in FIG. 6B, the attaching/removing levers 50 (the nuts 52) are rotated by 90° such that the longer side of the bottom end of each attaching/removing lever 50 extends along the left-right direction. Thus, it is not possible to remove the attaching/removing levers 50 from the fixing holes 40, and the trailing end clamps 36 are attached to the peripheral surface of the rotating drum 24. At this time, due to the lower ends of the aforementioned coil springs being pressed toward the peripheral surface of the rotating drum 24, the trailing end pressing plates 48 at the front ends of the predetermined number of trailing end clamps 36 press substantially the entire trailing end of the printing plate 12 against the peripheral surface of the rotating drum 24 due to the urging force of the coil springs. The trailing end of the printing plate 12 is thereby fixed to the peripheral surface of the rotating drum 24. Further, when the respective attaching/removing levers 50 are rotated by 90° as described above, the trailing end clamps 36 separate from the rising/falling frame 34, and thereafter, the rising/falling frame 34 is raised to its origin position.

As shown in FIG. 3, the attaching/removing levers 50 are disposed at the front side of the trailing end clamp 36. The mass of the trailing end clamp 36 at the region thereof toward the rear side of the attaching/removing levers 50 is greater than the mass of the trailing end clamp 36 at the region thereof toward the front side of the attaching/removing levers 50. Therefore, when the rotating drum 24 is rotated at high speed, the centrifugal force received by the region of the trailing end clamp 36 at the rear side of the attaching/removing levers 50 is greater than the centrifugal force received by the region of the trailing end clamp 36 at the front side of the attaching/removing levers 50. In this way, torque, in a direction of directing the trailing end pressing plates 48 toward the peripheral surface of the rotating drum 24, is applied to the trailing end clamp 36.

At this time, the vicinities of the left-right direction ends of each trailing end pressing plate 48 are pressed by the trailing end clamp 36. In this way, each trailing end pressing plate 48 deforms in a direction of moving away from the rotating drum 24 due to the centrifugal force. The deformation becomes greater the further toward the left-right direction center of the trailing end pressing plate 48.

Figure 4:
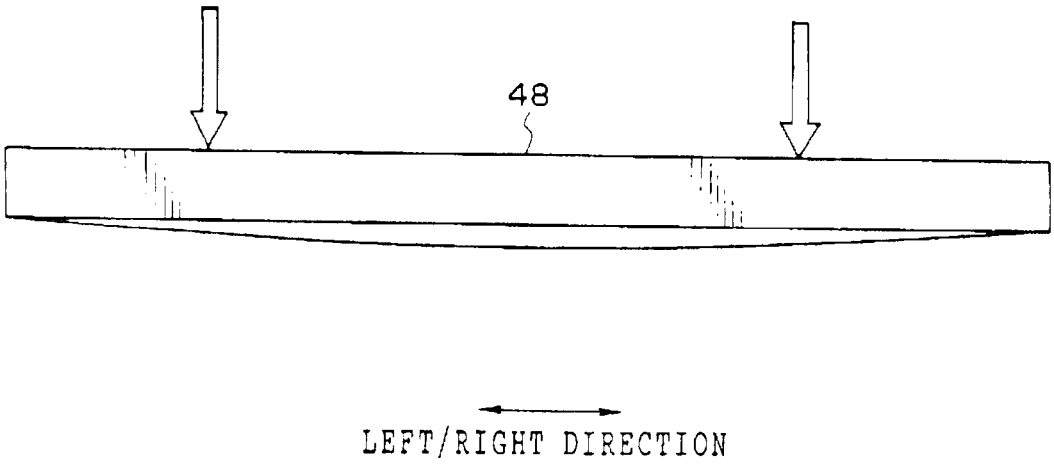
FIG. 4 is a front view showing a trailing end pressing plate of the automatic printing plate exposure device relating to the embodiment of the present invention.

As shown in FIG. 4, the bottom end of the trailing end pressing plate 48 (the end at the rotating drum 24 side) is formed in a bow shape (crown shape) in which the left-right direction center protrudes further downwardly (toward the rotating drum 24) than both left-right direction ends. The bottom end of the trailing end pressing plate 48 protrudes toward the rotating drum 24 progressively more, the further toward positions of the trailing end pressing plate 48 where the amount of deformation thereof in the direction of moving away from the rotating drum 24, due to the centrifugal force at the time when the rotating drum 24 is rotated at high speed, increases. In this way, when the rotating drum 24 is rotated at high speed, the lower end of the trailing end pressing plate 48 becomes planar due to the deformation of the trailing end pressing plate 48.

In this way, when the leading end and the trailing end of the printing plate 12 are fixed to the peripheral surface of the rotating drum 24 by the leading end clamps 26 and the trailing end clamps 36, the squeeze roller 30 is moved away from the rotating drum 24, and thereafter, the rotating drum 24 is rotated at high speed at a predetermined rotational speed.

As shown in FIG. 7, a recording head portion 38 is disposed in a vicinity of the rear side of the peripheral surface of the rotating drum 24. The recording head portion 38 is, synchronously with the rotation of the rotating drum 24, operated toward the rotating drum 24 which is being rotated at high speed. Then, the recording head portion 38 irradiates a light beam, which has been modulated on the basis of read image data, so as to expose the printing plate 12 on the basis of the image data. This exposure processing is so-called scan-exposure in which the recording head portion 38 is moved in the axial direction of the rotating drum 24 while the rotating drum 24 is rotated at high speed. Here, the rotation of the rotating drum 24 is main scanning, and movement in the axial direction of the rotating drum 24 is subscanning.

When the scan-exposure of the printing plate 12 has been completed, the rotating drum 24 is stopped temporarily at the position at which the trailing end clamps 36 oppose the rising/falling frame 34. After the rising/falling frame 24 has been lowered toward the rotating drum 24, the attaching/removing levers 50 (the nuts 52) are rotated reversely by 90°. In this way, the longer sides of the bottom ends of the attaching/removing levers 50 are disposed along the front-rear direction, and the attaching/removing levers 50 can be removed from the fixing holes 40, and the trailing end clamps 36 are attached to the rising/falling frame 34. Thereafter, by raising the rising/falling frame 34 to its origin position, the fixing of the trailing end of the printing plate 12 by the trailing end pressing plates 48 at the front ends of the trailing end clamps 36 is released. Moreover, the conveying guide unit 14 is pivoted such that the plate discharging guide 22 is made to correspond to the exposure section 18 (opposes the rotating drum 24 in a direction tangential to the rotating drum 24). Thereafter, by rotating the rotating drum 24 in the direction of arrow B in FIG. 7, the printing plate 12 is discharged, from the trailing end side thereof, onto the plate discharging guide 22. At this time, the respective attaching cams 28 are rotated and press the front sides of the leading end clamps 26. The fixing of the leading end of the printing plate 12 by the leading end pressing portions 42 at the rear ends of the leading end clamps 26 is thereby released. When the printing plate 12 is fed to the plate discharging guide 22, the conveying guide unit 14 is pivoted, and the printing plate 12 is discharged from the plate discharging guide 22. In this way, the printing plate 12 is conveyed to the developing device or printing device (neither is illustrated) which is the subsequent process adjacent to the automatic printing plate exposure device 10.

Next, operation of the present embodiment will be described.

In the automatic printing plate exposure device 10 having the above-described structure, the printing plate 12 is placed on the plate supplying guide 20. First, the conveying guide unit 14 is pivoted such that the plate supplying guide 20 correspond to the punching section 16. Then, the leading end portion of the printing plate 12 is conveyed into the punching section 16. A predetermined number of punch holes are formed by the punching section 16 in the leading end portion of the printing plate 12 which has been conveyed into the punching section 16. Thereafter, the printing plate 12 is returned onto the plate supplying guide 20.

Then, the conveying guide unit 14 is pivoted so that the plate supplying guide 20 corresponds to the exposure section 18. The printing plate 12 is conveyed to the exposure section 18 and positioned. The leading end and the trailing end of the printing plate 12 which has been positioned are fixed to the peripheral surface of the rotating drum 24 by the leading end clamps 26 and the trailing end clamps 36, respectively. Simultaneously, while the printing plate 12 is made to fit tightly to the peripheral surface of the rotating drum 24 by the squeeze roller 30, the printing plate 12 is trained on the peripheral surface of the rotating drum 24. When the printing plate 12 has been trained onto the peripheral surface of the rotating drum 24, a light beam from the recording head portion 38 is irradiated onto the printing plate 12 in the state in which the rotating drum 24 is being rotated at high speed. In this way, exposure processing is carried out.

When exposure processing has been completed, the conveying guide unit 14 is pivoted such that the plate discharging guide 22 corresponds to the rotating drum 24. Then, while the fixing of the printing plate 12 to the peripheral surface of the rotating drum 24 by the leading end clamps 26 and trailing end clamps 36 is released, the printing plate 12 is discharged from the rotating drum 24 to the plate discharging guide 22. Thereafter, the conveying guide unit 14 is pivoted and the printing plate 12 is discharged out from the plate discharging guide 22.

Here, in the exposure section 18, the leading end clamps 26 and the trailing end clamps 36, which are provided at the peripheral surface of the rotating drum 24, press the printing plate 12 against the peripheral surface of the rotating drum 24 by the leading end pressing portions 42 and the trailing end pressing plates 48. In this way, the printing plate 12 is fixed to the peripheral surface of the rotating drum 24. Thus, not only the conventional large number of suction holes and suction grooves are unnecessary, but also, a pressure-reducing blower is not needed. Thus, the structure can be made to be lower cost, requires less space for placement, and does not generate sound.

When the rotating drum 24 is rotating at high speed, the leading end pressing portions 42 and the trailing end pressing plates 48, due to centrifugal force, deform in directions of moving away from the rotating drum 24. The further toward the left-right direction center of the leading end pressing portion 42 and the trailing end pressing plate 48, the greater the deformation. Here, the left-right direction center of the bottom end of the leading end pressing portion 42 and the bottom end of the trailing end pressing plate 48 project in a bow-like manner further downward than the left-right direction both ends. In this way, the leading end pressing portions 42 and the trailing end pressing plates 48 protrude toward the rotating drum 24. The leading end pressing portions 42 and the trailing end pressing plates 48 protrude progressively more, the further toward positions thereof where the amount of deformation in the direction of moving away from the rotating drum 24, due to the centrifugal force at the time when the rotating drum 24 is rotated at high speed, increases. Thus, even if the leading end pressing portions 42 and the trailing end pressing plates 48 deform due to centrifugal force when the rotating drum 24 is rotated at high speed, the bottom ends of the leading end pressing portions 42 and the bottom ends of the trailing end pressing plates 48 become planar and can press the printing plate 12 without a gap therebetween. In this way, the leading end pressing portions 42 and the trailing end pressing plates 48 can uniformly press the printing plate 12 against the peripheral surface of the rotating drum 24 and make the printing plate 12 fit tightly against the peripheral surface of the rotating drum 24.

Further, when the rotating drum 24 is rotated at high speed, the centrifugal force received by the region of the leading end clamp 26 at the front side of the supporting shafts 46 is greater than the centrifugal force received by the region of the leading end clamp 26 at the rear side of the supporting shafts 46. Torque, in the direction of directing the leading end pressing portion 42 toward the peripheral surface of the rotating drum 24, is applied to the leading end clamp 26. Moreover, when the rotating drum 24 is rotated at high speed, the centrifugal force received by the region of the trailing end clamp 36 at the rear side of the attaching/removing levers 50 is greater than the centrifugal force received by the region of the trailing end clamp 36 at the front side of the attaching/removing levers 50. Torque, in the direction of directing the trailing end pressing plates 48 toward the peripheral surface of the rotating drum 24, is applied to the trailing end clamp 36. In this way, the leading end pressing portions 42 and the trailing end pressing plates 48 can press the printing plate 12 against the peripheral surface of the rotating drum 24 at a high pressure.

Substantially the entire leading end of the printing plate 12 is pressed against the peripheral surface of the rotating drum 24 by the leading end pressing portions 42. Moreover, substantially the entire trailing end of the printing plate 12 is pressed against the peripheral surface of the rotating drum 24 by the trailing end pressing plates 48. In addition, as described above, the leading end pressing portions 42 and the trailing end pressing plates 48 uniformly press the printing plate 12 against the peripheral surface of the rotating drum 24 at a high pressure. Thus, when the rotating drum 24 is rotated at high speed, the printing plate 12 can be prevented from, due to centrifugal force, floating up off of the peripheral surface of the rotating drum 24 against the pressing force of the leading end pressing portions 42 and the trailing end pressing plates 48. Accordingly, the entire printing plate 12 can be made to fit tightly against the peripheral surface of the rotating drum 24. Thus, it is possible to prevent the recorded image from becoming blurry due to the distance between the recording head portion 38 and the printing plate 12 changing.

Figure 8:
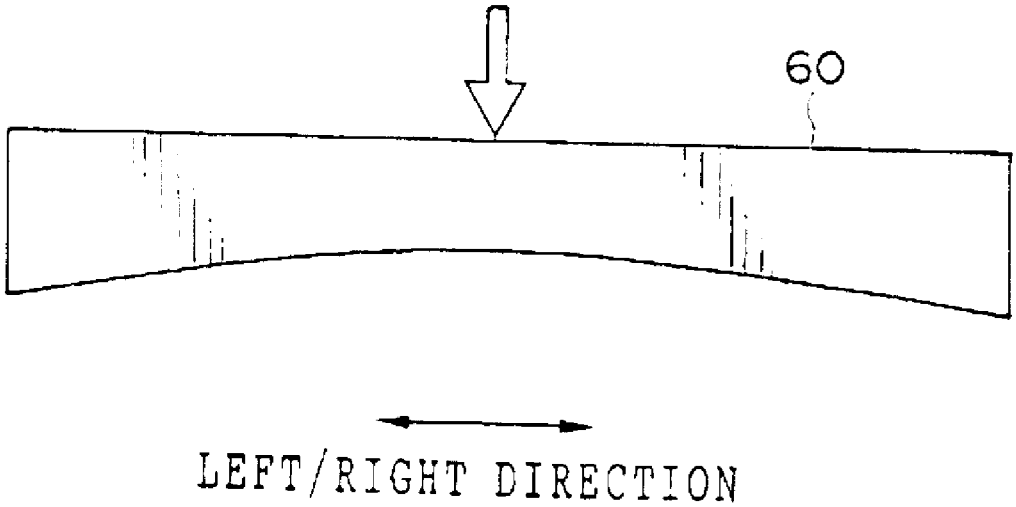
FIG. 8 is a front view showing another example of a pressing portion of the automatic printing plate exposure device relating to the embodiment of the present invention.

The present embodiment is a structural example in which, when the rotating drum 24 is rotated at high speed, the leading end pressing portions 42 and the trailing end pressing plates 48 deform in directions of moving away from the rotating drum 24 due to the centrifugal force, and the deformation is greater the further toward the left-right direction centers of the leading end pressing portions 42 and the trailing end pressing plates 48. However, as shown in FIG. 8, in a case in which a pressing portion 60 is structured such that, when the rotating drum 24 (rotating member) rotates, the pressing portion 60 deforms due to centrifugal force such that the left-right direction center of the pressing portion 60 is pressed toward the rotating drum 24, and the further toward the left-right direction both ends, the more the pressing portion 60 moves away from the rotating drum 24, it suffices to form the bottom end of the pressing portion 60 (the end at the rotating drum 24 side) to be bow-shaped such that the left-right direction both end portions project further downward (toward the rotating drum 24 side) than the left-right direction center. In this way, the pressing portion 60 protrudes toward the rotating drum 24 progressively more, the further toward positions of the pressing portion 60 where the amount of deformation thereof in a direction of moving away from the rotating drum 24, due to the centrifugal force at the time when the rotating drum 24 is rotated, increases. Even if the pressing portion 60 deforms due to centrifugal force at the time when the rotating drum 24 is rotated, the bottom end of the pressing portion 60 becomes planar, and can press the printing plate 12 without a gap therebetween. The pressing portion 60 can uniformly press the printing plate 12 against the peripheral surface of the rotating drum 24.

In the sheet material fixing device of the present invention, due to the pressing portion of the holding member pressing the sheet material against the peripheral surface of the rotating member, the sheet material is fixed to the peripheral surface of the rotating member. Accordingly, there is no need for the conventional suction holes, suction grooves and pressure-reducing blower. A structure in which costs are reduced, less space is required for placement, and which does not generate noise can be realized.

Moreover, the pressing portion projects more toward the rotating member, the further toward positions of the pressing portion where the amount of deformation thereof toward the side opposite the rotating member, due to the centrifugal force at the time when the rotating member rotates, increases. Accordingly, even if the pressing portion deforms toward the side opposite the rotating member due to centrifugal force, the pressing portion can press the sheet material without a gap therebetween, and the pressing portion can uniformly press the sheet material against the peripheral surface of the rotating member.

In addition, when the sheet material fixing device of the present invention is provided with a plurality of holding members and pressing portions, some of the pressing portions press one end of the sheet material against the peripheral surface of the rotating member, whereas the other pressing portions press the other end of the sheet material against the peripheral surface of the rotating member. Accordingly, the entire sheet material can be made to fit tightly against the peripheral surface of the rotating member when the rotating member is rotated.

What is claimed is:

1. A sheet material fixing device comprising:

a rotating member which is rotatable and on whose peripheral surface a sheet material is disposed;

a holding member provided at the peripheral surface of the rotating member; and a pressing portion provided at the holding member, and formed so as to project more toward the rotating member the further toward positions of the pressing portion where an amount of deformation thereof in a direction of moving away from the rotating member due to centrifugal force at the time when the rotating member rotates increases, the pressing portion pressing the sheet material against the peripheral surface of the rotating member.

2. The sheet material fixing device of claim 1, wherein a plurality of the holding members and a plurality of the pressing portions are provided, and some of the pressing portions press one end of the sheet material against the peripheral surface of the rotating member, and others of the pressing portions pressanother end of the sheet material against the peripheral surface of the rotating member.

3. The sheet material fixing device of claim 1, wherein the holding member has a sheet material leading end clamp, and elastic force in a direction of moving away from the rotating member is applied to a front side of the leading end clamp, and the pressing portion is formed at a rear side of the leading end clamp.

4. The sheet material fixing device of claim 2, wherein a longitudinal direction of the pressing portion is parallel to an axial direction of the rotating member, and the pressing portion is formed in a bow shape such that a central portion of the pressing portion in the longitudinal direction is a portion which projects furthest toward the rotating member.

5. The sheet material fixing device of claim 2, wherein a longitudinal direction of the pressing portion is parallel to an axial direction of the rotating member, and the pressing portion is formed in a bow shape such that both end portions of the pressing portion in the longitudinal direction are portions which project furthest toward the rotating member.

6. The sheet material fixing device of claim 2, wherein the sheet material is a printing plate, and the sheet material fixing device is applied to an automatic exposure device.

7. The sheet material fixing device of claim 3, wherein the leading end clamp has a supporting member and a supporting shaft at each left-right direction end of the leading end clamp, and the supporting members are fixed to the peripheral surface of the rotating member, and the supporting shafts are supported by the supporting members respectively, and the leading end clamp is rotatably supported at the rotating member via the supporting members.

8. The sheet material fixing device of claim 3, wherein the leading end clamp has an attaching cam disposed above the rotating member, and the attaching cam can press and can release pressing of the front side of the leading end clamp, and when the attaching cam presses the front side, the pressing portion separates from the rotating member, and when the attaching cam releases pressing, the pressing portion presses a leading end of the sheet material against the peripheral surface of the rotating member and fixes the leading end thereat.

9. The sheet material fixing device of claim 3, wherein the holding member has a sheet material trailing end clamp, and the trailing end clamp is formed in a substantially rectangular plate shape, and the pressing portion is provided at a front end of the trailing end clamp.

10. The sheet material fixing device of claim 3, wherein the holding member has a plurality of the trailing end clamps.

11. The sheet material fixing device of claim 7, wherein the supporting shafts are disposed at the rear side of the leading end clamp, and a mass of the leading end clamp at a region of the leading end clamp toward a front side of the supporting shafts is greater than a mass of the leading end clamp at a region of the leading end clamp toward a rear side of the supporting shafts.

12. The sheet material fixing device of claim 9, wherein a surface of the pressing portion of the trailing end clamp is a rubber-coated metal.

13. The sheet material fixing device of claim 9, wherein the trailing end clamp has a pair of attaching/removing levers for attaching the trailing end clamp to the rotating member, and the trailing end clamp is swingable with respect to the attaching/removing levers.

14. The sheet material fixing device of claim 9, wherein the holding member has a plurality of the trailing end clamps.

15. The sheet material fixing device of claim 13, wherein when the trailing end clamp is attached to the peripheral surface of the rotating member via the attaching/removing levers, the pressing portions are elastically pressed against the peripheral surface of the rotating member, and a trailing end of the sheet material is fixed to the peripheral surface of the rotating member.

16. The sheet material fixing device of claim 13, wherein the trailing end clamp can be attached and attachment of the trailing end clamp can be released by the attaching/removing levers being rotated.

* * * * *